US007938683B2

(12) United States Patent
Nagata

(10) Patent No.: US 7,938,683 B2
(45) Date of Patent: May 10, 2011

(54) CONNECTOR WITH A TUBULAR SHIELD WITH DOUBLE LEFT AND RIGHT SIDES FORMED FROM A SINGLE METAL PLATE

(75) Inventor: Takayuki Nagata, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 12/716,563

(22) Filed: Mar. 3, 2010

(65) Prior Publication Data

US 2010/0233905 A1 Sep. 16, 2010

(30) Foreign Application Priority Data

Mar. 13, 2009 (JP) ..... 2009-060585

(51) Int. Cl.
*H01R 13/648* (2006.01)

(52) U.S. Cl. ..... 439/607.13

(58) Field of Classification Search ..... 439/607.13, 439/607.27, 607.45, 607.55, 607.09
See application file for complete search history.

(56) References Cited

U.S. PATENT DOCUMENTS 5,013,262 A * 5/1991 Shibano ..... 439/607.4
5,035,652 A * 7/1991 Shibano ..... 439/607.47
6,682,368 B2 * 1/2004 Murr et al. ..... 439/607.28
7,771,235 B2 * 8/2010 Kameyama ..... 439/607.27
2009/0209130 A1 * 8/2009 Kameyama et al. ..... 439/607.27

FOREIGN PATENT DOCUMENTS

| | | |
|---|---|---|
| JP | 10-064636 | 3/1998 |
| JP | 3056506 | 11/1998 |
| JP | 11-067365 | 3/1999 |
| JP | 2000-515302 | 11/2000 |
| JP | 2001-076826 | 3/2001 |
| JP | 2008-103271 | 5/2008 |

* cited by examiner

*Primary Examiner* — Chandrika Prasad
(74) *Attorney, Agent, or Firm* — Rankin, Hill & Clark LLP

(57) ABSTRACT

The invention provides a connector wherein a highly reliable shielding performance can be realized while reducing the production cost and the size. A connector includes a shield cover configured by one metal plate. In the shield cover, a tubular portion which forms a fitting portion for a plug, mounting terminals for a printed circuit board, first contact pieces for a shield member of the plug, and second contact pieces for a case of an apparatus are integrally disposed. In the tubular portion, inner and outer double right and left side plates are disposed. The mounting terminals are configured by right and left extended portions downward projected from portions of the outer right and left side plates in rear of a front end opening of the tubular portion. The second contact pieces are configured by elastic pieces inward extended from the front end faces of the mounting terminals.

4 Claims, 5 Drawing Sheets

CONNECTOR WITH A TUBULAR SHIELD WITH DOUBLE LEFT AND RIGHT SIDES FORMED FROM A SINGLE METAL PLATE

TECHNICAL FIELD

The present invention relates to a connector which is to be mounted on a printed circuit board, and more particularly to a connector which includes a shield cover for electrically connecting a shield member of a plug that is a counter connector, to a printed circuit board, and which is a so-called EMI (electromagnetic interference) shielded connector.

BACKGROUND OF THE INVENTION

In such a connector, usually, a shield cover is contacted with a case of an apparatus in a plug insertion port to establish a grounding connection, thereby enhancing the shielding performance. For example, Patent Literatures 1 to 6 listed below disclose a connector in which, in addition to mounting terminals for a printed circuit board and a contact piece for a shield member of a plug, a contact piece for a case is disposed in a plug insertion port of a shield cover.

[Patent Literature 1] Japanese Patent Application Laying-Open No. 10-64636

[Patent Literature 2] Japanese Patent Application Laying-Open No. 11-67365

[Patent Literature 3] Published Japanese Translation of PCT Patent Application No. 2000-515302

[Patent Literature 4] Japanese Utility Model Registration No. 3,056,506

[Patent Literature 5] Japanese Patent No. 3,098,520

[Patent Literature 6] Japanese Patent Application Laying-Open No. 2008-103271

In a so-called EMI shielded connector, as in a connector in which no countermeasure is taken, cost reduction and miniaturization are strongly requested, and a high shielding performance must be realized while satisfying these requests.

In the connectors disclosed in, for example, Patent Literatures 4 to 6, a contact piece for a case is disposed as a separate member in a shield cover, and hence the number of components is increased. Consequently, there arises a problem in that the assembling manpower is correspondingly increased and the production cost is raised.

By contrast, the connectors disclosed in, for example, Patent Literatures 1 to 3 include a shield cover in which mounting terminals for a printed circuit board, a contact piece for a shield member of a plug, and a contact piece for a case are integrally disposed by applying punching and bending processes on one metal plate. The production cost can be suppressed as compared with the connectors disclosed in, for example, Patent Literatures 4 to 6.

In the case of the connector disclosed in, for example, Patent Literature 2, however, a simple outward-directed flange which is disposed in the opening edge of a plug insertion port is used as a contact piece for a case. In the case where the connector is pryed when the plug is inserted, for example, there is a possibility that the contact piece may be separated from the case to disconnect the grounding connection (see Paragraphs 0002 to 0011 and the like of Patent Literature 1). Furthermore, there is a problem in that the outer shape of the connector becomes large. In the case where the contact piece (outward-directed flange) is screwingly fastened to the case (see the flange portion 56 and the like of Patent Literature 6), the outer shape of the contact piece must be further enlarged. Therefore, the outer shape of the connector is further enlarged, and the number of components is increased. Consequently, the assembling manpower is correspondingly increased and the production cost is raised.

By contrast, in the case of the connectors disclosed in, for example, Patent Literatures 1 and 3, an elastic piece in which the tip end is pressingly contacted with the case is used as a contact piece for the case. Even in the case where the connector is pryed when the plug is inserted, for example, the contact piece can maintain the contact state with the case because of the elasticity of the contact piece. Therefore, the reliability of the shielding performance is more easily ensured as compared with the case of, for example, the connector disclosed in Patent Literature 2.

In the case of the connector disclosed in, for example, Patent Literature 1, however, an elastic piece which is partly cut and raised from the outward-directed flange disposed in the opening edge of the plug insertion port is used as a contact piece for the case. Similarly with the case of the connector disclosed in, for example, Patent Literature 2, there is a problem in that the outer shape of the connector becomes large. On the other hand, in the case of the connector disclosed in, for example, Patent Literature 3, the plurality (upper and lower two stages) of plug insertion ports are formed by one shield cover. An elastic piece is inward extended from the opening edge which is between the upper and lower plug insertion ports, and used as the contact piece for the case, so that the contact piece does not interfere with the inserted plug. There is no problem in that, as in the case of the connector disclosed in, for example, Patent Literature 1, the outer shape of the connector becomes large. However, the configuration cannot be employed in a connector in which only one plug insertion port is formed by one shield cover as in, for example, the connector disclosed in Patent Literature 1. In a connector in which only one plug insertion port is formed by one shield cover, therefore, only a contact piece which is outward extended from the opening edge of the plug insertion port can be disposed (a contact piece which is inward extended interferes with an inserted plug), and hence there is a problem in that the outer shape of the connector is inevitably large.

In the case of the connector disclosed in, for example, Patent Literature 3, an elastic piece which is inward extended from the opening edge of a plug insertion port while being bent with forming a small gap with respect to a case that is immediately in front thereof is formed as a contact piece for the case. Therefore, the bend radius of the contact piece from the opening edge of the plug insertion port cannot be set to be large, the contact piece is restricted to have a short length, and a large stress is produced in the contact piece, thereby causing problems in that breakage or plastic deformation easily occurs, and that adequate elasticity is hardly obtained. When the gap between the opening edge of the plug insertion port and the case is enlarged, the shielding performance is reduced.

In a conventional connector which is so-called EMI shielded connector, as described above, it is difficult to realize a highly reliable shielding performance while reducing the production cost and the size.

The invention has been conducted in view of above-discussed circumstances. It is an object of the invention to provide a connector in which a highly reliable shielding performance can be realized while reducing the production cost and the size.

SUMMARY OF THE INVENTION

In order to achieve the object, the connector of the invention is a connector including: a body 10 which is made of an insulator; a plurality of metal-made contacts 20 which are held by the body 10; and a shield cover 30 which is configured by one metal plate, wherein, in the shield cover 30, a tubular portion 32 which surrounds peripheries of contact portions 21 of the contacts 20 to form a fitting portion 31 for a counter connector P, mounting terminals 33 for a circuit board 100, first contact pieces 34 for a shield member of the counter connector P, and a second contact piece 35 for a case 200 of an apparatus are integrally disposed, in the tubular portion 32, inner and outer double right and left side plates 46, 47, 42, 43 are disposed, in the outer right and left side plates 42, 43 of the tubular portion 32, right and left extended portions which are downward projected from portions in rear of a front end opening of the tubular portion 32 are disposed, the mounting terminals 33 are configured by the right and left extended portions, in at least one 33 of the right and left mounting terminals 33, an elastic piece which is inward extended from a front end face of the mounting terminal is disposed, and the second contact piece 35 is configured by the elastic piece.

When, as in the connector of the invention, the shield cover 30 is configured so that the right and left side plates of the tubular portion 32 are disposed inward and outward or doubly, the right and left mounting terminals 33 which are downward projected respectively from portions in rear of the front end opening of the tubular portion 32 are disposed by the extended portions of the outer right and left side plates 42, 43 of the tubular portion, and the elastic piece which is inward extended from the front end face of at least one of the right and left mounting terminals 33 is configured as the second contact piece (a contact piece for the case of the apparatus) 35, the bend radius of the basal end portion and overall length of the second contact piece 35 can be sufficiently ensured. Although the second contact piece 35 is formed as an inward-directed piece which does not cause the outer shape of the connector to be enlarged, adequate elasticity is easily obtained, and the shield cover 30 is contacted with the case 200 of the apparatus through the second contact piece 35. Therefore, a stable and sure grounding connection can be obtained.

In the connector of the invention, preferably, in the tubular portion 32, a rectangular top plate 41, the outer right and left side plates 42, 43 which are configured by extended portions that are disposed in right and left side portions of the top plate 41, the inner right and left side plates 46, 47 which are configured by extended portions that are disposed in rear side portions of the outer right and left side plates 42, 43 through folded back portions 44, 45, and right and left half bottom plates 48, 49 which are configured by extended portions that are disposed in lower side portions of the inner right and left side plates 46, 47 are disposed.

When the configuration is employed, a seam joint 50 between the right and left half bottom plates 48, 49 is formed in the middle portion of the bottom face of the tubular portion 32. However, the outer right and left side plates 42, 43 of the tubular portion 32 are engaged with the circuit board 100 by the right and left mounting terminals 33. When the connector is pryed when the counter connector P is inserted, therefore, the joint 50 is opened, and the tubular shape of the tubular portion 32 is deformed, whereby fitting and contact failures, or the like can be prevented from occurring.

In the connector of the invention, preferably, in lower portions of the outer right and left side plates 42, 43, right and left bent portions 54, 55 which are inward bent along bent shapes between the inner right and left side plates 46, 47 and the right and left half bottom plates 48, 49 are disposed.

When the configuration is employed, the right and left bent portions 54, 55 play a role of ribs which enhance the strengths of the metal plate portions forming the outer right and left side plates 42, 43 and the right and left mounting terminals 33, and the tubular shape of the tubular portion 32 is formed by vertically combining the U-like shape which is configured by the top plate 41 and the outer right and left side plates 42, 43, and which is downward opened, with that which is configured by the right and left half bottom plates 48, 49 and the inner right and left side plates 46, 47, and which is upward opened, so as to cause the inner and outer right and left side plates 46, 42, 47 43 to overlap each other. The right and left bent portions 54, 55 enable the upward-opened U-like shape to be embraced in the downward-opened U-like shape, so that the strength against prying caused by the counter connector P can be further enhanced.

According to the invention, it is possible to provide a connector in which a highly reliable shielding performance can be realized while reducing the production cost and the size.

DETAILED DESCRIPTION OF THE INVENTION

Figure 1:
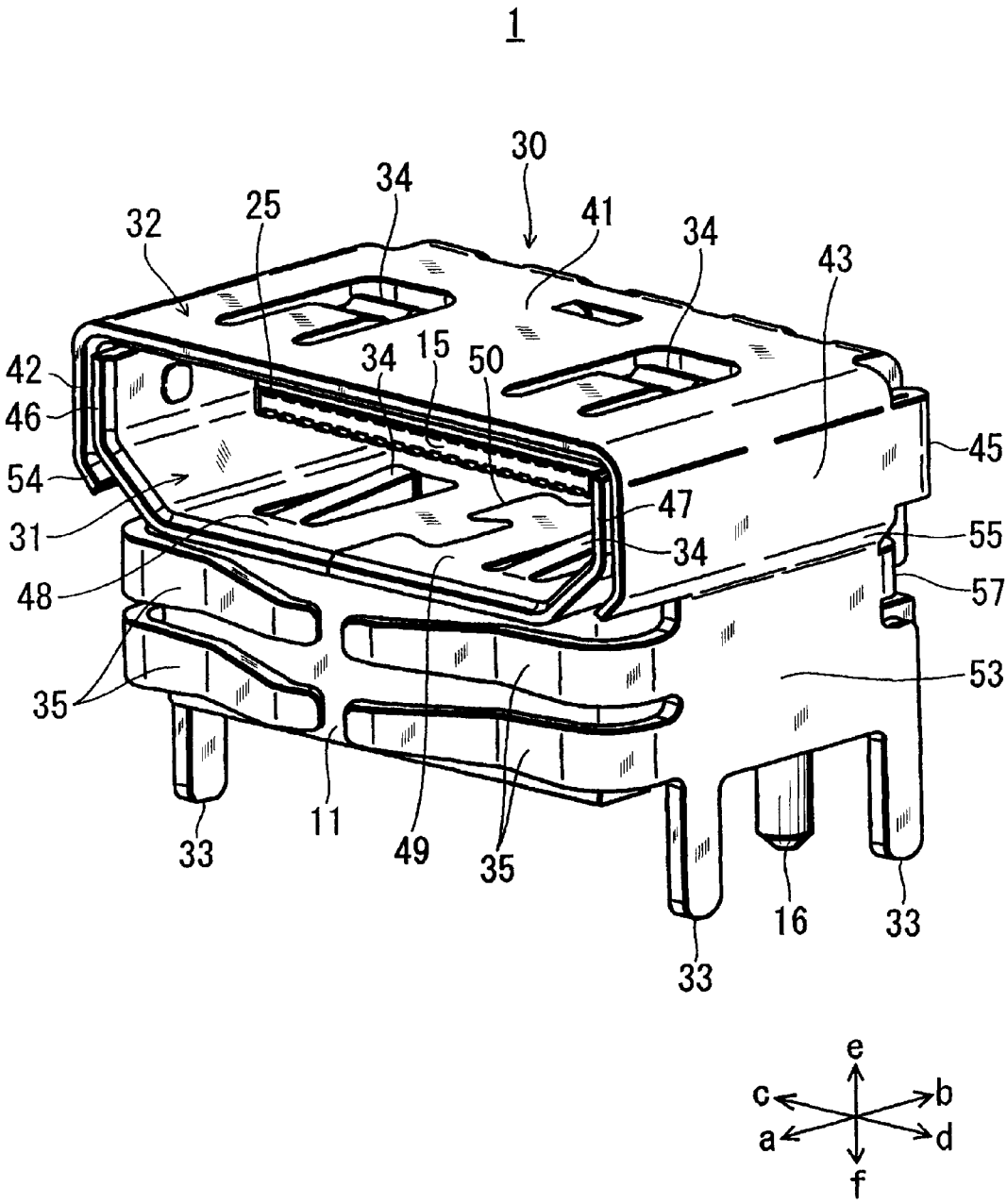
FIG. 1 is a perspective view showing the appearance of a connector of an embodiment of the invention.
Figure 2:
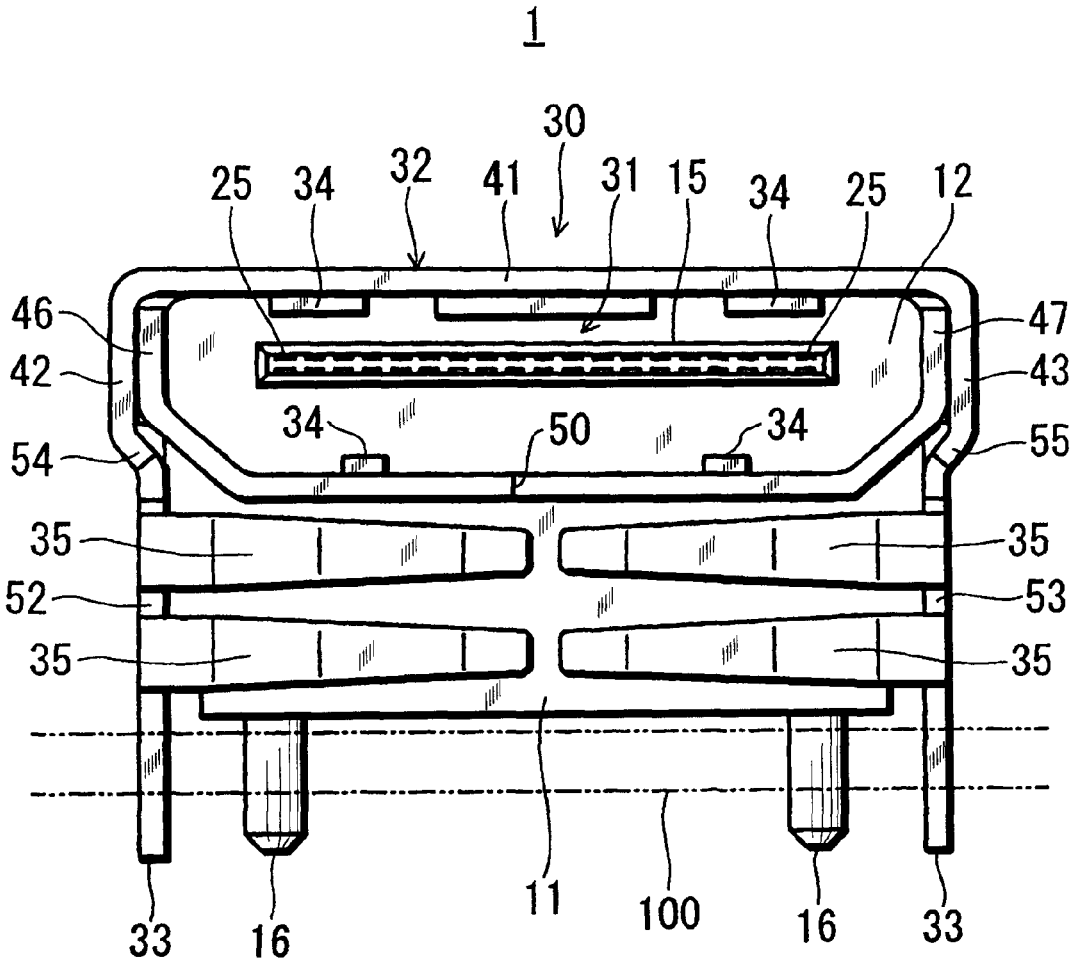
FIG. 2 is a front view showing the appearance of the connector of the embodiment of the invention.
Figure 3:
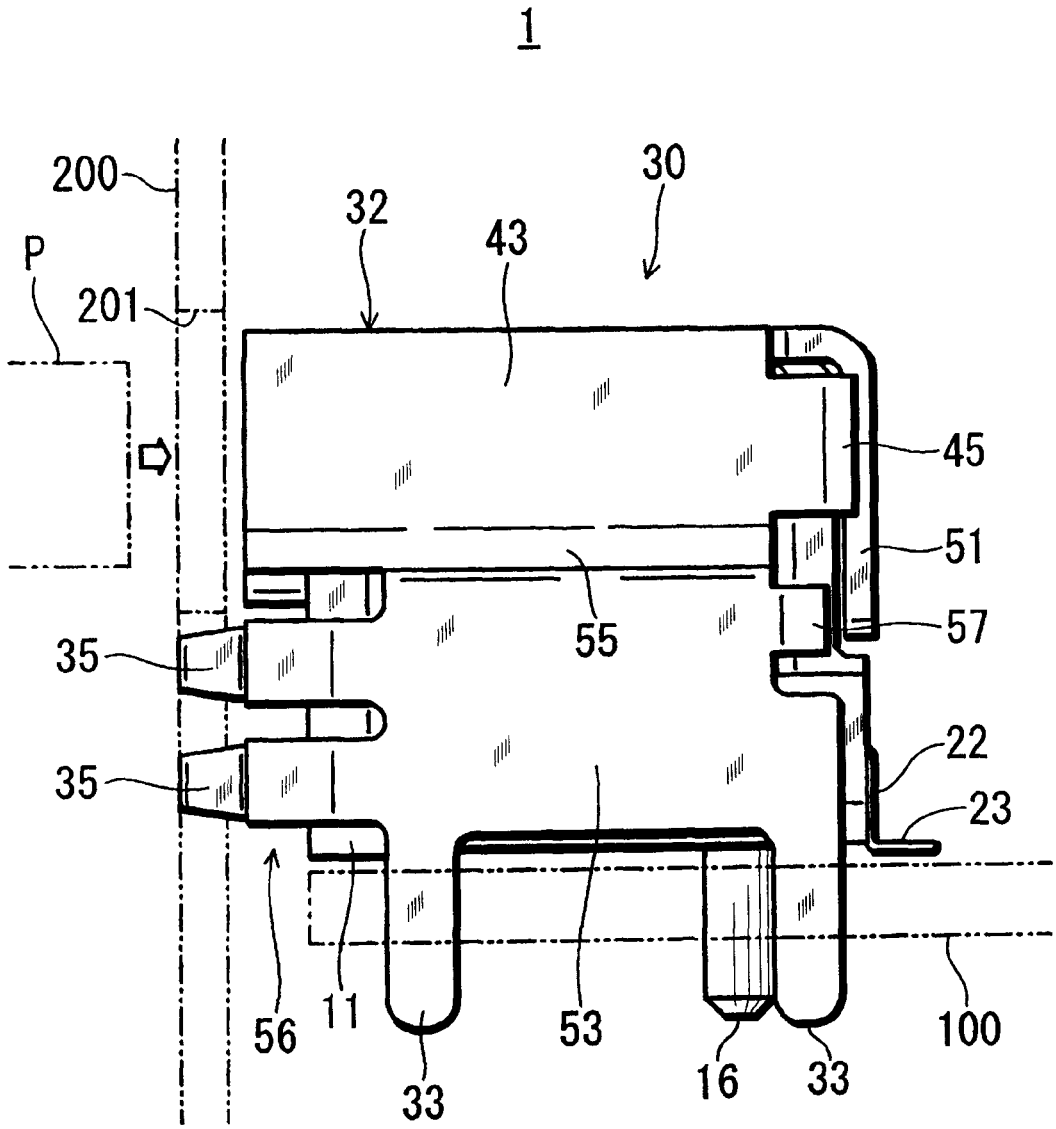
FIG. 3 is a side view showing the appearance of the connector of the embodiment of the invention.
Figure 4:
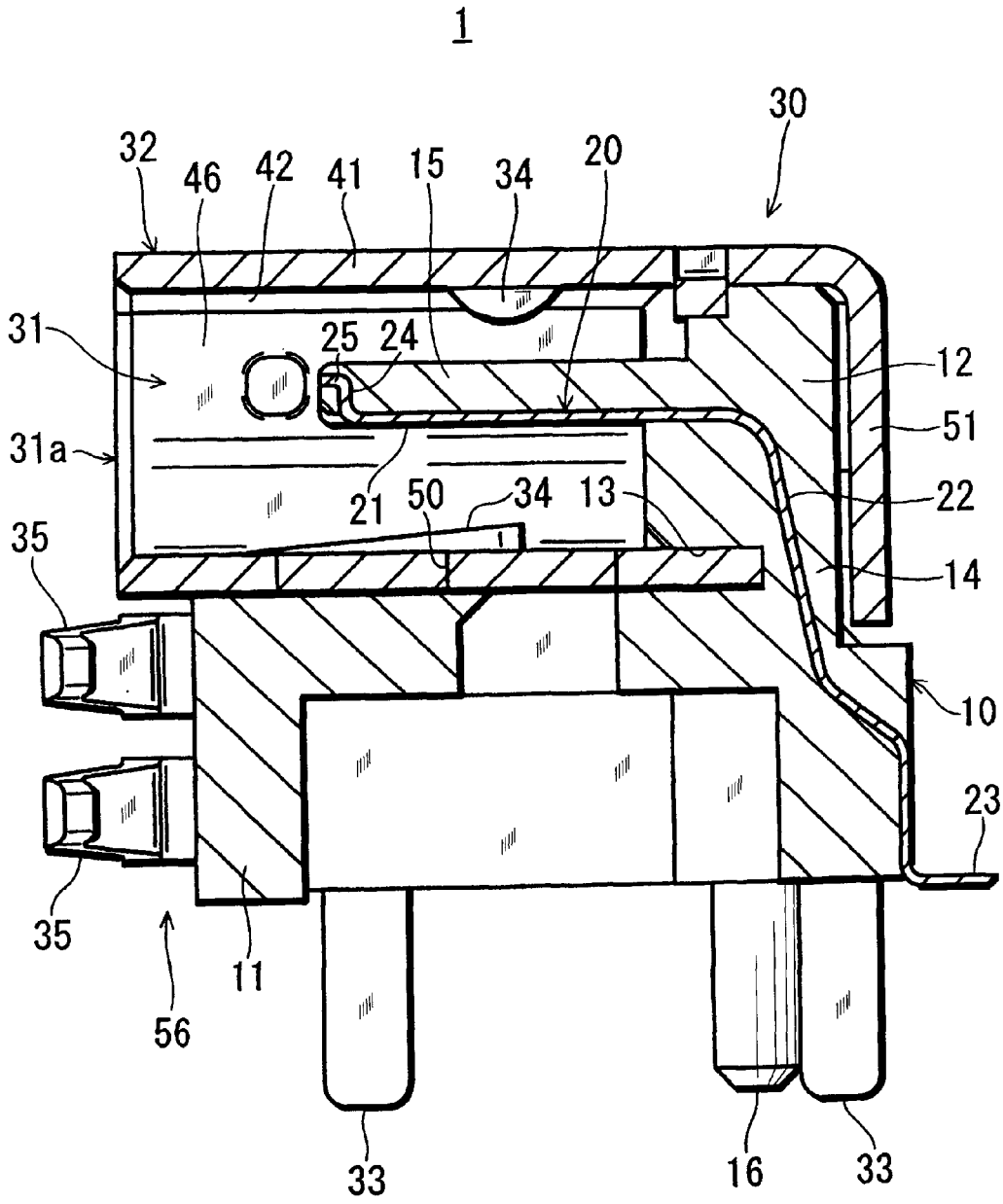
FIG. 4 is a sectional view showing the internal structure of the connector of the embodiment of the invention.

Hereinafter, an embodiment of the invention will be described with reference to the drawings. In the following description, it is assumed that the directions of arrows a-b in FIG. 1 coincide with the front and rear directions (the depth direction, the insertion/extraction directions of the counter connector) of the connector, the directions of arrows c-d coincide with the right and left directions (width direction) of the connector, and the directions of arrows e-f coincide with the upper and lower directions (height direction) of the connector.

The connector 1 of the embodiment shown in FIGS. 1 to 4 is an apparatus-side connector (socket) which is to be used in, for example, a PC, a peripheral apparatus thereof, or an AV apparatus while being mounted on an edge portion of a printed circuit board 100. The counter connector P for the connector 1 is a plug P such as a cable-side connector to be attached to an end of a connection cable between apparatuses, or a memory-side connector to be disposed on an external memory.

The connector 1 is configured by: a body 10 which is made of an insulator such as a synthetic resin; a plurality of metal-made contacts 20 which are integrally held by the body 10 by means of insert molding; and a shield cover 30 which is made of one metal plate, and in which a tubular portion 32 that surrounds the peripheries of contact portions 21 of the contacts 20 to form a fitting portion 31 for the plug P, mounting terminals 33 for the circuit board 100, first contact pieces 34 for a shield member of the plug P, and second contact pieces 35 for a case 200 of the apparatus are integrally disposed.

In the body 10, a body foot portion 11 which is downward opened, and which has a substantially rectangular box-like shape, a contact support basal portion 12 which is placed above a rear portion of the body foot portion 11, and which has a substantially rectangular parallelepiped shape, a coupling portion 14 which integrally couples a rear portion of the contact support basal portion 12 to the body foot portion 11 so as to form a gap 13 corresponding to the thickness of the metal plate forming the shield cover 30, between a front portion of the contact support basal portion 12 and the body foot portion 11, a flat-plate like contact supporting portion 15 which is forwardly projected from the front face of the contact support basal portion 12, and right and left positioning pins 16 which are downward projected from the lower face of the rear portion of the body foot portion 11 are integrally disposed.

The plurality (in the embodiment, 19) of contacts 20 are collectively formed by applying punching and bending processes (press process) on a metal plate (a hoop material) having a high electrical conductivity, in a state where they are laterally arranged in one row while the front and rear ends are connected to one another through carriers and predetermined gaps are formed in the right and left directions (width direction). The contacts in the state are set into molds of a molding machine. After insert molding, the front and rear carriers are cut off, so that the 19 individual contacts 20 are attached and held to the body 10.

In each of the contacts 20, a thin contact portion 21 which is extended in the front and rear directions, a continuous portion 22 which is rearward extended in an oblique downward direction from a rear end part of the contact portion 21, a mounting terminal 23 which is rearward extended from an inclined lower end part of the continuous portion 22, a step portion 24 which is formed in the vicinity of a tip end part (front end part) of the contact portion 21, and which is upward directed, and an embedded portion 25 which is configured by the front end part of the contact portion 21 that is raised by one level from the step portion 24 are continuously integrally disposed.

In a state where the contacts 20 are attached and held to the body 10, the continuous portions 22 are embedded into a rear resin portion of the body 10, the contact portions 21 are forward extended on the lower surface of the contact supporting portion 15 from the front face of the contact support basal portion 12 to the front end, and laterally arranged in one row on the lower surface of the contact supporting portion 15 while forming predetermined gaps in the right and left directions. In order to allow the lower surfaces of the contact portions 21 which are in rear of the step portions 24, to be exposed substantially flushly from the lower surface of the contact supporting portion 15, the step portions 24, the embedded portions 25 which are in front thereof, and the thickness portions of the contact portions 21 which are in rear of the step portions 24 are embedded into the resin of the contact supporting portion 15. The mounting terminals 23 are projected from a lower end portion of the rear face of the body foot portion 11 to the outside of the body 10, and laterally arranged there in one row while forming predetermined gaps in the right and left directions. The lower surfaces of the mounting terminals 23 of the contacts 20 are substantially flush with the lower face of the body foot portion 11 (the lower face of the body 10).

In place of the insert molding by which the contacts 20 are attached and held to the body 10, a method may be employed in which grooves to which the contacts 20 are to be pressingly fixed are formed simultaneously with the molding of the body 10, and, after the molding of the body 10, the contacts 20 are pressingly fixed to the grooves to be attached and fixed to the body.

The shield cover 30 is formed by applying punching and bending processes (press process) on one metal plate, and has a one-piece structure.

In the tubular portion 32 of the shield cover 30, a rectangular top plate 41 which constitutes the upper face of the connector 1, outer right and left side plates 42, 43 in which extended portions that are disposed in right and left side portions of the top plate 41 are bent downward substantially perpendicularly to be opposed to each other in the right and left directions of the connector 1, inner right and left side plates 46, 47 in which extended portions that are disposed in rear side portions of the outer right and left side plates 42, 43 through folded back portions 44, 45 are forward folded back in the folded back portions 44, 45 to overlap the insides of the outer right and left side plates 42, 43, and right and left half bottom plates 48, 49 in which extended portions that are disposed in lower side portions of the inner right and left side plates 46, 47 are bent upward (inward) substantially perpendicularly to be formed as one bottom plate, and opposed to the top plate 41 in the upper and lower directions of the connector 1 are disposed. The tubular portion is formed into a tubular shape which has a seam 50 in the bottom face.

The seam joint 50 between end portions of the right and left half bottom plates 48, 49 is formed into a convex and concave shape in which inverted trapezoidal convex portions and trapezoidal concave portions are alternately continuous to one another.

In the top plate 41 of the tubular portion 32, a rear side plate 51 in which an extended portion disposed in a rear side portion is bent downward substantially perpendicularly to close the rear opening of the tubular portion 32 is integrally disposed. In the outer right and left side plates 42, 43 of the tubular portion 32, right and left terminal plates 52, 53 which are configured by extended portions that are downward extended therefrom, and that are opposed to each other below the tubular portion 32 in the right and left directions of the connector 1 are integrally disposed.

In the tubular portion 32, four first contact pieces which are configured by cantilevered elastic pieces (plate springs) that are formed by partially cutting and raising two places of the top plate 41 and one place of each of the right and left half bottom plates 48, 49, or a total of four places are integrally disposed. Each of the four first contact pieces 34 is formed so that a front end portion is a fixed end portion, and a rear end portion is a free end portion which is elastically displaceable in the upper and lower directions of the connector 1. In a free state, the free end portion is projected into the interior of the tubular portion 32.

Alternatively, cantilevered elastic pieces (plate springs) that are formed by partially cutting and raising the inner right and left side plates 46, 47 may be used as the first contact pieces 34.

The right and left terminal plates 52, 53 have a front end face at a position which is retracted by a predetermined dimension from the front end of the tubular portion 32. In the right and left terminal plates 52, 53, four mounting terminals 33 which are configured by thin extended portions that are extended downward straightly from two places of front and rear portions of the lower end faces of the plates are integrally disposed. Each the right and left terminal plates 52, 53 configures a terminal basal portion which is common to the two front and rear mounting terminals 33 that are configured by the extended portions of the plate.

In the right and left mounting terminals 33, four second contact pieces 35 which are configured by cantilevered elastic pieces that are formed by inward bending extended portions in their basal portions to be extended below the front end portion of the tubular portion 32 are integrally disposed. The extended portions are originally formed by extending forward from two upper and lower portions of the front end faces of the right and left terminal plates 52, 53 constituting the front faces of the terminal basal portions of the mounting terminals. The four second contact pieces 35 are formed so that outer end portions on the sides of the right and left terminal plates 52, 53 are fixed end portions, and inner end portions on the tip end sides are free end portions which are elastically displaceable in the front and rear directions of the connector 1. In a free state, the free end portions are projected more forward than the front end of the tubular portion 32.

In lower portions of the outer right and left side plates 42, 43, right and left bent portions 54, 55 which are inward bent along bent shapes between the inner right and left side plates 46, 47 and the right and left half bottom plates 48, 49 are integrally disposed. The right and left terminal plates 52, 53 are downward extended from end portions of the right and left bent portions 54, 55.

Figure 5:
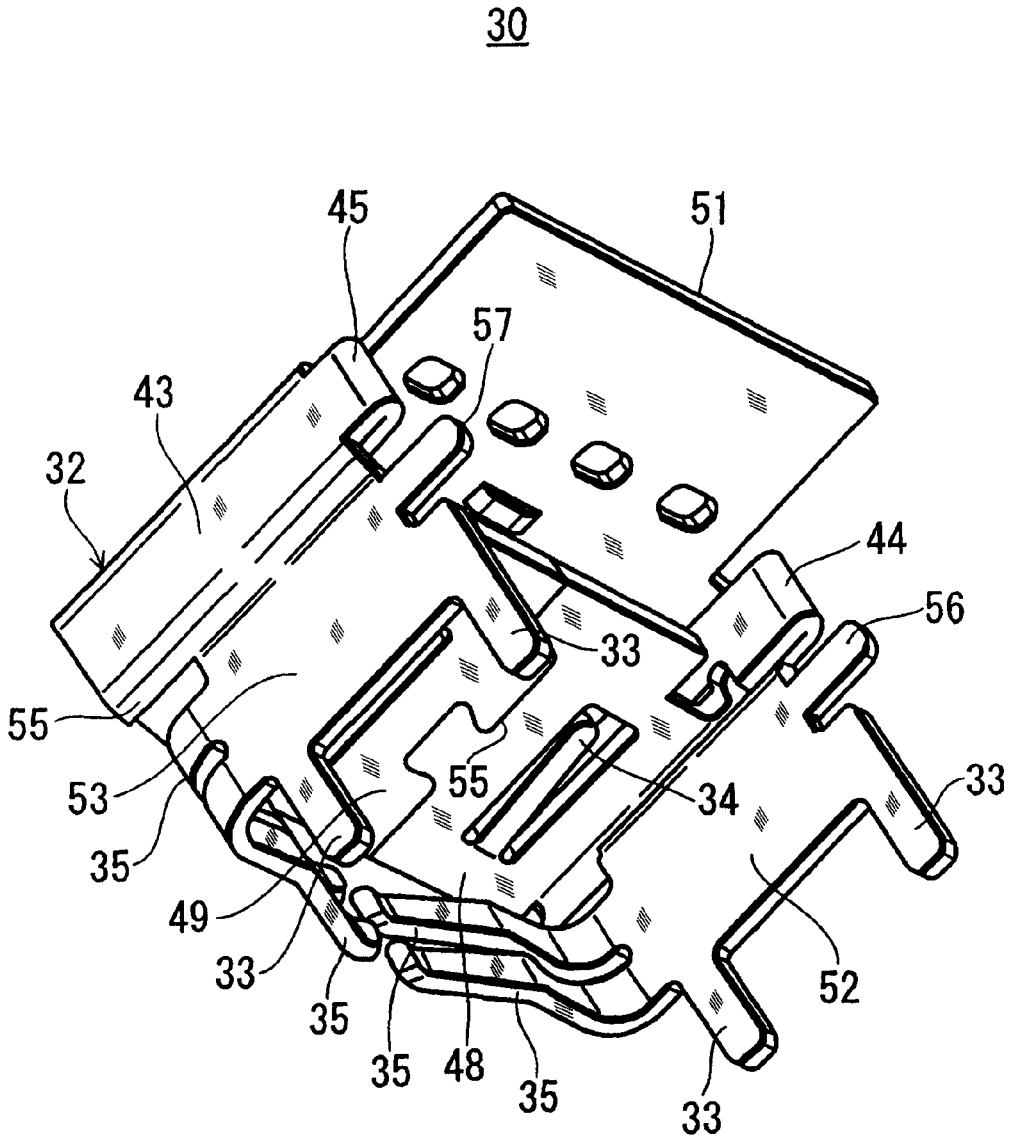
FIG. 5 is a perspective view showing a semi-assembled state of a shield cover in the connector of the embodiment of the invention.

The connector 1 is assembled in the following manner. As shown in FIG. 5, the rear side plate 51 is rearward extended from the top plate 41, and the shield cover 30 is assembled in a semi-assembled state where the rear opening of the tubular portion 32 is opened. The body 10 to which the plural contacts 20 are attached and held is pressingly inserted from the rear side into the shield cover 30 in the semi-assembled state. While the body foot portion 11 is pressingly inserted between the right and left terminal plates 52, 53 below the tubular portion 32, the contact support basal portion 12 is fitted into the rear portion of the tubular portion 32 through the gap 13. Right and left engaging pieces 56, 57 which are rearward projected from the right and left terminal plates 52, 53 are bent inward substantially perpendicularly to be engaged with the rear face of the body 10, thereby preventing the body 10 from slipping off from the shield cover 30. The rear side plate 51 which is rearward extended from the top plate 41 is bent downward substantially perpendicularly to cover the rear face of the contact support basal portion 12, and, as shown in FIGS. 1 to 4, the shield cover 30 is completely assembled, thereby completing the assembling process.

In the assembled state of the connector 1, as shown in FIGS. 1 to 4, the body foot portion 11 supports from the lower side the tubular portion 32 which is extended in the front and rear directions of the connector 1, except the front end portion of the tubular portion, whereby a space 56 is formed below the front end portion of the tubular portion 32.

The contact support basal portion 12 is fitted into the rear portion of the tubular portion 32 to close the rear opening of the tubular portion 32, and, in the tubular portion 32, the contact supporting portion 15 is projected from the front face of the contact support basal portion 12 toward the front opening of the tubular portion 32. In the lower surface of the contact supporting portion 15, the contact portions 21 of the contacts 20 are supported in the state where the contact portions are laterally arranged in one row while forming predetermined gaps in the right and left directions. The tubular portion 32 surrounds the peripheries of the contact portions 21 (the contact supporting portion 15) of the contacts 20 to form the fitting portion 31 in which the front opening is disposed as a plug insertion port 31*a*. The plug P can be inserted from the front side into the fitting portion 31 through the plug insertion port 31*a*. In this way, the first contact pieces 34 respectively configured by the elastic pieces are disposed in the tubular portion 32 forming the fitting portion 31.

The mounting terminals 23 of the contacts 20 are outward projected from the lower end portion of the rear face of the body foot portion 11, and laterally arranged there in one row while forming predetermined gaps in the right and left directions, in a state where the lower surfaces are substantially flush with the lower face of the body foot portion 11 (the lower face of the connector 1).

The right and left side faces of the body foot portion 11 are covered by the right and left terminal plates 52, 53. The front and rear mounting terminals 33 which use the right and left terminal plates 52, 53 as the common terminal basal portions are projected from two places of the front and rear portions of the lower end faces of the right and left terminal plates 52, 53, to be lower than the lower face of the body foot portion 11. The right and left positioning pins 16 are downward projected from the lower face of the body foot portion 11 between the right and left mounting terminals 33.

The upper and lower second contact pieces 35 are inward extended by bending two places of the upper and lower portions of the front end faces of the right and left terminal plates 52, 53 which are the terminal basal portions of the right and left mounting terminals 33, so that the second contact pieces 35 which are two respectively in the upper and lower sides or four in total are disposed in the space 56 which is in front of the body foot portion 11 and below the front end portion of the tubular portion 32. In the second contact pieces 35, the outer end portions on the sides of the right and left terminal plates 52, 53 are formed as the fixed end portions, and the inner end portions on the tip end sides are formed as the free end portions which are elastically displaceable in the front and rear directions of the connector 1. In a free state, the free end portions are projected more forward than the front end of the tubular portion 32.

The connector 1 of the embodiment is configured as described above. When the connector is to be mounted on an edge portion of the printed circuit board 100, the right and left positioning pins 16 are inserted respectively into positioning holes disposed in the printed circuit board 100, and the mounting terminals 33 of the shield cover 30 are inserted respectively into through holes disposed in the printed circuit board 100, whereby the lower face of the body foot portion 11, the lower surfaces of the mounting terminals 23 of the contacts 20, and the lower end faces of the right and left terminal plates 52, 53 are placed on the upper face of the printed circuit board 100.

The mounting terminals 23 of the contacts 20 are soldered to corresponding land portions of the printed circuit board 100 by a soldering process such as the reflow process or the flow process, so that the mounting terminals are mechanically fixed to the printed circuit board 100 and electrically connected to circuits configured in the printed circuit board 100. Furthermore, the mounting terminals 33 of the shield cover 30 are soldered in the through holes of the printed circuit board 100, so that the mounting terminals are mechanically fixed to the printed circuit board 100 and electrically connected to an electromagnetic shielding layer configured in the printed circuit board 100.

In the connector 1 which is mounted on the edge portion of the printed circuit board 100 as described above, when the printed circuit board 100 is incorporated into an apparatus, the fitting portion 31 is opposed to the interior of a plug insertion port 201 which is opened in the case 200 of the apparatus. The plug P can be inserted from the outside of a apparatus into the fitting portion 31 through the plug insertion port 201 of the case 200 and the plug insertion port 31*a* of the fitting portion 31. The free end portions of the second contact pieces 35 are pressed against the inner face of the case 200 by their elasticity to be contacted therewith, and the shield cover 30 is electrically connected to the case 200 by the second contact pieces 35 to establish a grounding connection. A panel face of the case 200 to which the second contact pieces 35 are to be contacted is in a plane perpendicular to the insertion direction of the plug P.

In the connector 1 which is attached to the apparatus as described above, when the plug P is inserted and fitted into the fitting portion 31 from the outside of the apparatus through the plug insertion port 201 of the case 200 and the plug insertion port 31*a* of the fitting portion 31, the contact portions 21 (stationary contacts) of the contacts 20 are contacted with corresponding stationary contacts of the plug P, so that the stationary contacts of the plug P are electrically connected to the circuits configured in the printed circuit board 100 through the contacts 20, and the free end portions of the first contact pieces 34 are pressed against a shield member of the plug P by their elasticity to be contacted therewith, so that the shield cover 30 causes the shield member of the plug P to be electrically connected to the circuit configured in the printed circuit board 100, so that the first contact pieces are electrically connected to the case 200 to establish a grounding connection.

In this way, the connector 1 is tightly electrically coupled to the shield cover 30, the shield member of the plug P, the printed circuit board 100, and the case 200 of the apparatus to be integrated as a shield, so that the shielding performance is enhanced.

In the connector 1, the shield cover 30 is provide with the second contact pieces 35 for the case 200, in addition to the mounting terminals 33 for the printed circuit board 100 and the first contact pieces 34 for the shield member of the plug P. The shield cover 30 is formed by one metal plate, and has the one-piece structure in which the mounting terminals 33 for the printed circuit board 100, the first contact pieces 34 for the shield member of the plug P, and the second contact pieces 35 for the case 200 are integrally disposed. As compared with a conventional connector or the like in which a second contact piece for a case is disposed as a separate member in a shield cover, the number of components is reduced, and correspondingly the assembling manpower is reduced, and the production cost can be suppressed.

The second contact pieces 35 for the case 200 are configured by the elastic pieces in which the free end portions (tip end portions) are pressingly contacted with the case 200. Even when the connector 1 is pryed when the plug P is inserted, therefore, the second contact pieces 35 can maintain the contact state with the case 200 because of the elasticity of the contact pieces. As compared with a conventional connector such as that in which a simple outward-directed flange disposed in the opening edge of a plug insertion port is used a contact piece for a case, it is possible to ensure a highly reliable shielding performance. In this case, unlike a conventional connector such as that in which an outward-directed flange that is disposed in the opening edge of a plug insertion port, and that is fastened to a case by screwing is used as a contact piece for the case, the number of components is reduced, and correspondingly the assembling manpower is reduces, and the production cost is nit increased.

In the shield cover 30, the right and left side plates of the tubular portion 32 are disposed inward and outward or doubly, the right and left mounting terminals 33 which are downward projected respectively from the portions in rear of the front end opening (plug insertion port 31*a*) of the tubular portion 32 are formed by the extended portions of the outer right and left side plates 42, 43, and the elastic pieces which are inward extended from the front end face of the right and left mounting terminals 33 are configured as the second contact pieces 35 for the case 200 of the apparatus. Therefore, the bend radius and overall length of the basal end portions of the second contact pieces 35 can be sufficiently ensured as compared with a conventional connector or the like in which an elastic piece which is inward extended from the opening edge of a plug insertion port while being bent with forming a small gap with respect to a case that is immediately in front thereof is formed as a contact piece for the case. Although the second contact pieces 35 are formed as inward-directed ones which do not cause the outer shape to be set to be large, a stress acting on the second contact pieces 35 is relaxed, and adequate elasticity at which breakage or plastic deformation hardly occurs is easily obtained. Moreover, the shield cover 30 is contacted with the case 200 through the second contact pieces 35. As compared with a conventional connector or the like in which an elastic piece which is inward extended from the opening edge of a plug insertion port while being bent with forming a small gap with respect to a case that is immediately in front thereof is formed as a contact piece for the case, therefore, a stable and sure grounding connection can be established, and the gap between the plug insertion port 31*a* and the case 200 can be made small as far as possible, so that the shielding performance can be improved. In the connector 1, only one plug insertion port 31*a* is formed in one shield cover 30. Even in the connector 1, the second contact pieces 35 can be inward extended, and hence the size increase due to the second contact pieces 35 can be prevented from occurring, and the size can be reduced. It is a matter of course that the outer shape of the connector is not enlarged by the contact pieces for the case, unlike a conventional connector such as that in which a simple outward-directed flange disposed in the opening edge of a plug insertion port is used as a contact piece for a case, that in which an outward-directed flange that is disposed in the opening edge of a plug insertion port, and that is fastened to a case by screwing is used as a contact piece for the case, and that in which an elastic piece that is partially cut and raised from an outward-directed flange disposed in the opening edge of a plug insertion port is used as a contact piece for a case.

In the shield cover 30, the right and left side plates of the tubular portion 32 are disposed inward and outward or doubly, the right and left mounting terminals 33 which are downward projected respectively from the portions in rear of the front end opening (plug insertion port 31*a*) of the tubular portion 32 are formed by the extended portions of the outer right and left side plates 42, 43, and the elastic pieces which are inward extended from the front end face of the right and left mounting terminals 33 are configured as the second contact pieces 35 for the case 200 of the apparatus. Therefore, it is possible to prevent a situation where, during a period before the circuit board 100 on which the connector 1 is mounted is attached to an apparatus, the second contact pieces 35 are hooked by an external article or a finger to be deformed, from occurring.

In the shield cover 30, the right and left side plates of the tubular portion 32 are disposed inward and outward or doubly, the right and left mounting terminals 33 which are downward projected respectively from the portions in rear of the front end opening (plug insertion port 31*a*) of the tubular portion 32 are formed by the extended portions of the outer right and left side plates 42, 43, and the elastic pieces which are inward extended from the front end face of the right and left mounting terminals 33 are configured as the second contact pieces 35 for the case 200 of the apparatus. Therefore, the number of the second contact pieces 35 can be freely set in view of the EMI characteristics and in accordance with the distance to the case 200 to which the contact pieces are to be contacted, and the limitation of the contact pressure.

Alternatively, the second contact pieces 35 may be configured as follows. One contact piece may be inward extended from the front end face of the one terminal plate 52 or 53, a plurality of contact pieces (i.e., two contact pieces) may be inward extended from the front end face of the one terminal plate 52 or 53, one contact piece may be inward extended from the front end faces of the terminal plates 52, 53, or a plurality of contact pieces (i.e., two contact pieces) may be inward extended from each of the front end faces of the terminal plates 52, 53. In the case where the second contact pieces 35 are inward extended from the front end faces of the terminal plates 52, 53, the maximum length of the second contact pieces 35 is limited to a substantially half of the lateral width of the tubular portion 32. In the case where a contact piece(s) is inward extended from the front end face of the one terminal plate 52 or 53, the length of the contact piece(s) can be extended to be substantially equal to the lateral width of the tubular portion 32. Even in the case where the second contact pieces 35 are inward extended from the front end faces of the terminal plates 52, 53, when the levels of the right and left second contact pieces 35 are made different from each other, the lengths of the contact pieces can be extended to be substantially equal to the lateral width of the tubular portion 32.

In the shield cover 30, the right and left side plates of the tubular portion 32 are disposed inward and outward or doubly, and the right and left mounting terminals 33 are formed by the extended portions of the outer right and left side plates 42, 43. Unlike a conventional connector in which cut and raised pieces that are formed by, for example, partially cutting and raising a bottom plate of a tubular portion are used as mounting terminals, the lengths of the mounting terminals are not limited. Therefore, the lengths of the right and left mounting terminals 33 (including the right and left terminal plates 52, 53) can be freely set, and the height from the printed circuit board 100 to the plug insertion port 31*a* can be freely set.

In the tubular portion 32, the rectangular top plate 41, the outer right and left side plates 42, 43 configured by the extended portions that are disposed in the right and left side portions of the top plate 41, the inner right and left side plates 46, 47 configured by the extended portions that are disposed in the rear side portions of the outer right and left side plates 42, 43 through the folded back portions 44, 45, and the right and left half bottom plates 48, 49 configured by the extended portions that are disposed in the lower side portions of the inner right and left side plates 46, 47 are disposed, and the tubular portion is formed into a tubular shape. Although the seam joint 50 between the right and left half bottom plates 48, 49 is formed in the middle portion of the bottom face of the tubular portion 32, therefore, the outer right and left side plates 42, 43 of the tubular portion 32 are engaged with the printed circuit board 100 by the right and left mounting terminals 33. When the connector is pryed when the plug P is inserted, therefore, the seam joint 50 is opened, and the tubular shape of the tubular portion 32 is deformed, whereby fitting and contact failures, or the like can be prevented from occurring.

In the lower portions of the outer right and left side plates 42, 43, the right and left bent portions 54, 55 which are inward bent along the bent shapes between the inner right and left side plates 46, 47 and the right and left half bottom plates 48, 49 are disposed. Therefore, the right and left bent portions 54, 55 play a role of ribs which enhance the strengths of the metal plate portions forming the outer right and left side plates 42, 43 and the right and left mounting terminals 33, and the tubular shape of the tubular portion 32 is formed by vertically combining the U-like shape which is configured by the top plate 41 and the outer right and left side plates 42, 43, and which is downward opened, and that which is configured by the right and left half bottom plates 48, 49 and the inner right and left side plates 46, 47, and which is upward opened, so as to cause the inner and outer right and left side plates 46, 42, 47 43 to overlap each other. The right and left bent portions 54, 55 enable the upward-opened U-like shape to be embraced in the downward-opened U-like shape, so that the strength against prying caused by the plug P can be further enhanced.

As described above, according to the connector 1, it is possible to provide a connector in which a highly reliable shielding performance can be realized while reducing the production cost and the size.

Although in the above, the embodiment of the invention in which only one plug insertion port is formed in one shield cover has been described, the invention is not restricted to the embodiment, but can be modified in various ways without departing the spirit of the invention. For example, the invention may be preferably applied also to a connector in which a plurality of plug insertion ports are formed in one shield cover.

DESCRIPTION OF REFERENCE NUMERALS

1 connector
P plug (counter connector)
10 body
20 contact
21 contact portion
30 shield cover
31 fitting portion
32 tubular portion
33 mounting terminal
34 first contact piece
35 second contact piece
41 top plate
42, 43 outer right and left side plates
44, 45 folded back portion
46, 47 inner right and left side plates
48, 49 right and left half bottom plates
50 seam joint
54, 55 right and left bent portions
100 printed circuit board
200 case

What is claimed is:

1. A shield connector for electrically connecting a counter connector to a circuit board comprising:

a body which is made of an insulator;

a plurality of metal-made contacts which are held by said body; and a shield cover which is configured by and formed from one metal plate, wherein, said shield cover integrally includes a tubular portion which surrounds peripheries of contact portions of said contacts to form a fitting portion for the counter connector, mounting terminals for the circuit board, first contact pieces for a shield member of the counter connector, and a second contact piece for a case of an apparatus, said tubular portion includes inner and outer double right and left side plates, said outer right and left side plates of said tubular portion includes respective right and left extended portions which are downward projected from portions in rear of a front end opening of said tubular portion, said mounting terminals are configured by said right and left extended portions, at least one of said right and left mounting terminals includes an elastic piece which is inward extended from a front end face of said mounting terminal toward the other of said mounting terminal, and said second contact piece is configured by said elastic piece.

2. A shield connector according to claim 1, wherein said tubular portion includes:

a rectangular top plate, said outer right and left side plates which are configured by extended portions that are disposed in right and left side portions of said top plate, said inner right and left side plates which are configured by extended portions that are disposed in rear side portions of said outer right and left side plates through folded back portions, and right and left half bottom plates which are configured by extended portions that are disposed in lower side portions of said inner right and left side plates.

3. A shield connector according to claim 1, wherein said tubular portion includes:

a rectangular top plate, said outer right and left side plates which are configured by extended portions that are disposed in right and left side portions of said top plate, said inner right and left side plates which are configured by extended portions that are disposed in rear side portions of said outer right and left side plates through folded back portions, and right and left half bottom plates which are configured by extended portions that are disposed in lower side portions of said inner right and left side plates, and, lower portions of said outer right and left side plates includes bent portions which are inward bent along bent shapes between said inner right and left side plates and said right and left half bottom plates.

4. A shield connector according to claim 1, wherein a panel face of the case of the apparatus to which the second contact piece is contacted is in a plane perpendicular to an insertion direction of the counter connector.

* * * * *